US005103177A

United States Patent [19]

Russell et al.

[11] Patent Number: 5,103,177

[45] Date of Patent: Apr. 7, 1992

[54] METHOD AND APPARATUS FOR DETERMINING THE AZIMUTH OF A BOREHOLE BY DERIVING THE MAGNITUDE OF THE TERRESTIAL MAGNETIC FIELD BZE

[76] Inventors: Anthony W. Russell, Drachlaw, Turriff, Abedeenshire AB5 7JB; Michael K. Russell, Lynworth House, High Street, Prestbury, Cheltenham, Gloucester GL52 3AU, both of Great Britain

[21] Appl. No.: 485,942

[22] Filed: Feb. 27, 1990

[30] Foreign Application Priority Data

Mar. 17, 1989 [GB] United Kingdom ..... 8906233

[51] Int. Cl.[5] ..... G01V 3/00; G01V 3/08; G01V 3/18; E21B 25/16

[52] U.S. Cl. ..... 324/346; 166/255; 175/45

[58] Field of Search ..... 324/221, 346, 356, 369; 166/255; 175/45, 61

[56] References Cited

U.S. PATENT DOCUMENTS 4,071,815 11/1978 Zemaneh, Jr. ..... 324/346
4,649,349 3/1987 Chiron et al. ..... 324/346
4,794,336 12/1988 Marlow et al. ..... 324/221

FOREIGN PATENT DOCUMENTS 0193230 2/1986 European Pat. Off. .

*Primary Examiner*—Walter E. Snow
*Attorney, Agent, or Firm*—Ratner & Prestia

[57] ABSTRACT

Borehole surveying methods and apparatus for surveying the true longitudinal magnetic field within a substantially non-magnetic drill collar. A plurality of longitudinal magnetic field measurements are made to provide a longitudinal-position-dependent series of magnetic field measurements BZ(z) which enable the true magnitude of the terrestial magnetic field BZe in the direction of the longitudinal axis of the borehole to be calculated on the basis that BZ(z)=BZe+E(z), where E(z) is the longitudinal-position-dependent longitudinal magnetic field error induced by the magnetism of the drill string and the bottom-hole assembly. Several different methods of calculation are described, including polar and non-polar magnetic error function models. The methods can be extended to a full survey of the borehole heading by contemporaneous measurements of two further magnetic fields in each of two mutually orthogonal axes each also orthogonal to the longitudinal axis, along with contemporaneous gravity vector component measurements in each of these three axes.

10 Claims, 7 Drawing Sheets

METHOD AND APPARATUS FOR DETERMINING THE AZIMUTH OF A BOREHOLE BY DERIVING THE MAGNITUDE OF THE TERRESTIAL MAGNETIC FIELD BZE

FIELD OF THE INVENTION

This invention relates to the surveying of boreholes, and more particularly but not exclusively to determining the true azimuth of a borehole.

When drilling a well for exploration and recovery of oil or gas, it is known to drill a deviated well, which is a well whose borehole intentionally departs from vertical by a significant extent over at least part of its depth. When a single drilling rig is offshore, a cluster of deviated wells drilled from that rig allows a wider area and a bigger volume to be tapped from the single drilling rig at one time and without expensive and time-consuming relocation of the rig than by utilising only undeviated wells. Deviated wells also allow obstructions to be by-passed during drilling, by suitable control of the deviation of the borehole as it is drilled. However, to obtain the full potential benefits of well deviation requires precise knowledge of the instantaneous location and heading of the bottom-hole assembly (including the drilling bit and steering mechanisms such as adjustable stabilisers). Depth of the bottom-hole assembly (or axial length of the borehole) can be determined from the surface, for example by counting the number of standard-length tubulars coupled into the drill string, or by less empirical procedures. However, determination of the location and heading of the bottom-hole assembly generally requires some form of downhole measurement of heading. Integration of heading with respect to axial length of the borehole will give the borehole location relative to the drilling rig.

In this context, the word "heading" is being used to denote the direction in which the bottom-hole assembly is pointing (i.e. has its longitudinal axis aligned), both in a horizontal and vertical sense. Over any length of the borehole which can be considered as straight for the purposes of directional analysis, the borehole axis in a deviated well will have a certain inclination with respect to true vertical. A vertical plane including this nominally straight length of borehole will have a certain angle (measured in a horizontal plane) with respect to a vertical plane including a standard direction; this standard direction is hereafter taken to be true magnetic north, and the said angle is the magnetic azimuth of the length of borehole under consideration (hereafter simply referred to as "azimuth"). The combination of inclination and azimuth at any point down the borehole is the heading of the borehole at that point; borehole heading can vary with depth as might be the case, for example, when drilling around an obstacle.

Instrumentation packages are known, which can be incorporated in bottom-hole assemblies to measure gravity and magnetism in a number of orthogonal directions related to the heading of the bottom-hole assembly. Mathematical manipulations of undistorted measurements of gravitational and magnetic vectors can produce results which are representative of the true heading at the point at which the readings were taken. However, the measurements of magnetic vectors are susceptible to distortion, not least because of the masses of ferrous materials incorporated in the drill string and bottom-hole assembly. Distortion of one or more magnetic vector measurements can give rise to unacceptable errors in the determination of heading, and undesirable consequences. Distortion of magnetic vectors in the region of the instrumentation arising from inherent magnetism of conventional drill string and bottom-hole assembly components can be mitigated by locating the instrumentation in a special section of drill string which is fabricated of non-magnetic alloy. However, such special non-magnetic drill string sections are relatively expensive. Moreover, the length of non-magnetic section required to bring magnetic distortion down to an acceptable level increases significantly with increased mass of magnetic bottom-hole assembly and drill string components, with consequent high cost in wells which use such heavier equipment, e.g. wells which are longer and/or deeper. Hence such forms of passive error correction may be economically unacceptable. Active error correction by the mathematical manipulation of vector readings which are assumed to be error-free or to have errors which are small may give unreliable results if the assumption is unwarranted.

Before describing the invention, several definitions will be detailed with reference to FIGS. 1 and 2 of the accompanying drawings, wherein:

FIG. 1 is a schematic elevational view of the bottom-hole assembly of a drill string; and FIG. 2 is a schematic perspective view of various axes utilised for denoting directions in three dimensions.

Referring first to FIG. 1, the bottom-hole assembly of a drill string comprises a drilling bit 10 coupled by a non-magnetic drill collar 12 and a set of drill collars 14 to a drill pipe 16. The drill collars 14 may be fabricated of a magnetic material, but the drill collar 12 is substantially devoid of any self-magnetism.

During local gravity and magnetic field vector measurements, the non-magnetic drill collar 12 houses a downhole instrumentation package schematically depicted at 18. (In reality, the package 18 would not be visible as is apparently the case in FIG. 1 since the package 18 is utilised within the interior of the collar 12). The downhole instrumentation package 18 is capable of measuring gravity vectors and local magnetic vectors, for example by the use of accelerometers and fluxgates respectively. The instrumentation package 18 may be axially and rotationally fixed with respect to the bottom-hole assembly, including the drilling bit 10, whose heading is to be determined; the instrumentation package 18 would then be rigidly mounted in the bottom-hole assembly, within the non-magnetic drill collar 12 which is fabricated of non-magnetic alloy. Alternatively, the package 18 could be lowered through the collar 12, either on a wireline or as a free-falling package, with internal recording of the local gravity vectors and the local magnetic vectors. The alternative procedures for measurement processing according to whether the instrumentation package 18 is axially fixed or mobile will be subsequently described.

Referring now to FIG. 2 for convenience of conceptual presentation and calculation references, a hypothetical origin or omni-axial zero point "0" is deemed to exist in the centre of the instrumentation package 18 (not shown in FIG. 2). Of the three orthogonal axes OX, OY and OZ defining the alignment of the instrumentation relative to the bottom-hole assembly, the OZ axis lies along the axis of the bottom-hole assembly, in a direction towards the bottom of the assembly and the bottom of a borehole 20 drilled by the drilling bit 10. The OX and OY axes, which are orthogonal to the OZ axis and therefore lie in a plane 0.N2.E1 (now defined as the "Z-plane") at right angles to the bottom-hole assembly axis OZ, are fixed with respect to the body (including the collar 12) of the bottom-hole assembly. As viewed from above, the OX axis is the first of the fixed axes which lies clockwise of the upper edge of the (inclined) bottom-hole assembly, this upper edge lying in the true azimuth plane 0.N2.N1.V of the bottom-hole assembly. The angle N2.0.X in the Z-plane 0.N2.E1 (at right angles to OZ axis) between the bottom-hole assembly azimuth plane 0.N2.N1.V and the OX axis is the highside angle "HS". The OY axis lies in the Z-plane 0.N2.E1 at right angles to the OX axis in a clockwise direction as viewed from above. A gravity vector measuring accelerometer (or other suitable device) is fixedly aligned with each of the OX, OY and OZ axes. A magnetic vector measuring fluxgate (or other suitable device) is fixedly aligned in each of the OX, OY and OZ axes. The instrumentation package 18 may be energised by any suitable known arrangement, and the instrumentation readings may be telemetered directly or in coded form to a surface installation (normally the drilling rig) by any suitable known method, or alternatively the instrumentation package 18 may incorporate computation means to process instrumentation readings and transmit computational results as distinct from raw data, or the instrumentation package 18 may incorporate recording means for internal recording of the local axial magnetic vectors for subsequent retrieval of the package 18 and on-surface processing of the recorded measurements.

Also notionally vectored from the origin 0 are a true vertical (downwards) axis OV, a horizontal axis ON pointing horizontally to true Magnetic North, and an OE axis orthogonal to the OV and ON axes, the OE axis being at right angles clockwise in the horizontal plane as viewed from above (i.e. the OE axis is a notional East-pointing axis).

The vertical plane 0.N2.N1.V including the OZ axis and OV axis is the azimuth plane of the bottom-hole assembly. The angle V.O.Z between the OV axis and the OZ axis, i.e. the angle in the bottom-hole assembly azimuth plane 0.N2.N1.V, is the bottom-hole assembly inclination angle "INC" which is the true deviation of the longitudinal axis of the bottom-hole assembly from vertical. Since the angles V.O.N1 and Z.O.N2 are both right angles and also lie in a common plane (the azimuth plane O.N2.N1.V), it follows that the angle N1.O.N2 equals the angle V.O.Z, and hence the angle N1.O.N2 also equals the angle "INC".

The vertical plane O.N.V. including the OV axis and the ON axis is the reference azimuth plane or true Magnetic North. The angle N.O.N1 measured in a horizontal plane O.N.N1.E.E1 between the reference azimuth plane O.N.V. (including the OV axis and the ON axis) and the bottom-hole assembly azimuth plane O.N2.N1.V (including the OV axis and the OZ axis) is the bottom-hole assembly azimuth angle "AZ".

The OX axis of the instrumentation package is related to the true Magnetic North axis ON by the vector sum of three angles as follows:

(1) horizontally from the ON axis round Eastwards (clockwise as viewed from above) to a horizontal axis O.N1 in the bottom-hole assembly azimuth plane O.N2.N1.V by the azimuth angle AZ (measured about the origin 0 in the horizontal plane);

(2) vertically upwards from the horizontal axis O.N1 in the azimuth plane O.N2.N1.V to an inclined axis O.N2 in the Z-plane (the inclined plane O.N2.E1 including the OX axis and the OY axis) by the inclination angle INC (measured about the origin 0 in a vertical plane including the origin 0); and (3) a further angle clockwise/Eastwards (as defined above) in the Z-plane from the azimuth plane to the OX axis by the highside angle HS (measured about the origin 0 in the inclined Z-plane O.N2.E1 which includes the origin 0).

Borehole surveying instruments measure the two traditional attitude angles, inclination and azimuth, at points along the path of the borehole. The inclination at such a point is the angle between the instrument longitudinal axis and the Earth's gravity vector direction (vertical) when the instrument longitudinal axis as aligned with the borehole path at that point. Azimuth is the angle between the vertical plane which contains the instrument longitudinal axis and a vertical reference plane which may be either magnetically or gyroscopically defined; this invention is concerned with the measurement of azimuth defined by a vertical reference plane containing a defined magnetic field vector.

Inclination and azimuth (magnetic) are conventionally determined from instruments which measure the local gravity and magnetic field components along the directions of the orthogonal set of instrument-fixed axes [OX,OY,OZ]; traditionally, OZ is the instrument longitudinal axis. Thus, inclination and azimuth are determined as functions of the elements of the measurement set {GX,GY,GZ,BX,BY,BZ}, where GX is the magnitude of the gravity vector component in direction OX,BX is the magnitude of the magnetic vector component in direction OX, etc. The calculations necessary to derive inclination and azimuth as functions of GX,GY,GZ,BX,BY,BZ are well known.

When the vertical magnetic reference plane is defined as containing the local magnetic field vector at the instrument location, the corresponding azimuth angle is known as the raw azimuth; if the vertical magnetic reference plane is defined as containing the Earth's magnetic field vector at the instrument location, the corresponding azimuth angle is known as absolute azimuth.

In practice, the value of the absolute azimuth is required and two methods to obtain it are presently employed:

(i) The instrumentation package is contained within a non-magnetic drill collar (NMDC) which is sufficiently long to isolate the instrument from magnetic effects caused by the proximity of the drill string (DS) above the instrument and the stabilizers, bit, etc. forming the bottom-hole assembly (BHA) below the instrument. In this case the Earth's magnetic field is uncorrupted by the DS and BHA and the raw azimuth measured is equal to the absolute azimuth.

(ii) The corrupting magnetic effect of the DS and BHA is considered as an error vector along direction OZ thereby leaving BX and BY uncorrupted (components only of the Earth's magnetic field). The calculation of the absolute azimuth can then be performed as a function of GX,GY,GZ,BX,BY,Be, where Be is some value (or combination of values) associated with the Earth's magnetic field.

The error in the measurement of absolute azimuth by method (ii) is dependent on the attitude of the instrument and may greatly exceed the error in the measurement of the raw azimuth; the reasons for this are summarised as follows:

(iii) the need to know the values of Earth's magnetic field components in instrument-magnetic-units to a high degree of accuracy:

(iv) an inherent calculation error due to the availability of only the uncorrupted cross-axis (BOXY) magnetic vector component. [This is analagous to measuring only the gravity component GZ and then attempting to determine the inclination (INC) from INC=ACOS(GZ), with the magnitude of Earth's gravity=1 instrument gravity-unit].

It is therefore an object of the invention to provide an improved method of surveying a borehole, and more particularly but not exclusively to provide an improved method of surveying the magnetic azimuth of a borehole.

SUMMARY OF THE INVENTION

According to the present invention there is provided a method of surveying the magnetic azimuth of a borehole penetrated by a magnetic drill string coupled through a substantially non-magnetic drill collar to a magnetic bottom-hole assembly, by deriving the true magnitude of the terrestial magnetic field BZe in the direction of the longitudinal axis of the borehole (the OZ axis as defined) in the region of the substantially non-magnetic drill collar, said method comprising the steps of measuring the longitudinal magnetic field BZ (the component of the magnetic field B in the direction OZ) at a plurality of points along the length of the substantially non-magnetic drill collar to provide a longitudinal-position-dependent series of magnetic field measurements BZ(z), and calculating BZe on the basis that $BZ(z)=BZe+E(z)$, where E(z) is the longitudinal-position-dependent longitudinal magnetic field error induced by magnetism of the drill string and bottom-hole assembly.

The calculation of BZe may be based on the assumption that the longitudinal magnetic field error E(z) is induced by a plurality of notional magnetic poles longitudinally distributed along the longitudinal axis adjacent the substantially non-magnetic drill collar. The plurality of notional magnetic poles assumed to be inducing the longitudinal magnetic field error E(z) may comprise one pole pair or a plurality of pole pairs.

However, it is not essential to calculate the longitudinal magnetic field error E(z) in terms of a magnetic pole model; any mathematical method or curve-matching exercise which results in the generation of a function E(z) such that the measured distribution BZ(z) is closely represented by $E(z)+K$ (where K is a constant) is sufficient to determine $BZe=K$.

Moreover, in order to generate the longitudinal-position-dependent longitudinal magnetic error E(z), it is not necessary to know the absolute positions of the measurement points at which the measurements of longitudinal magnetic field BZ are made to provide the longitudinal-position-dependent series of magnetic field measurement BZ(z). It is sufficient to know the positions of the measurement points relative to each other in order to determine the longitudinal magnetic error E(z).

The relative positions of the measurement points are known for the case where the instrumentation package or other local axial magnetic field vector measuring means contains a plurality of OZ fluxgates at known mutual spacings along the longitudinal Z axis and is static within the NMDC at the time of measurement, and also for the, case where the instrumentation package or other measuring means is suspended from a wireline and passes longitudinally through the non-magnetic drill collar at known depths controlled from the surface above the well.

In the case where the instrumentation package falls freely through the non-magnetic drill collar, measurements are generally not made at known increments of distance, but are made (and recorded) at known times or at known increments of time; a procedure for converting such time-separated measurements to distance-separated measurements is also comprised within the scope of the present invention and will be described subsequently.

The present invention also provides apparatus for carrying out the foregoing magnetic azimuth surveying method, said apparatus comprising an instrumentation package containing at least two longitudinal magnetic field measuring devices having a known fixed separation(s).

Said apparatus may alternatively comprise an instrumentation package containing at least two longitudinal magnetic field measuring devices having a known fixed mutual separation(s), and a recording means to which said magnetic field measuring devices are connected for recording a plurality of longitudinal magnetic field measurements performed by each said device at known times or at known increments of time as said instrumentation package moves through said substantially non-magnetic drill collar.

The foregoing magnetic azimuth surveying method may be extended to provide a method of surveying the heading of a borehole penetrated by a magnetic drill string coupled through a substantially non-magnetic drill collar to a magnetic bottom-hole assembly, by deriving the true magnitude of the terrestial magnetic field BZe in the direction of the longitudinal axis of the borehole in the region of the substantially non-magnetic drill collar, said method comprising the steps of measuring the longitudinal magnetic field BZ at a plurality of points along the length of the substantially non-magnetic drill collar to provide a longitudinal-position-dependent series of magnetic field measurements BZ(z), contemporaneously measuring the magnetic fields Bx and By in two mutually orthogonal axes each also orthogonal to the longitudinal axis, contemporaneously measuring gravity vector components in each of the said three axes to produce respective gravity vector measurements Gx, Gy and Gz, calculating BZe on the basis that $BZ(z)=BZe+E(z)$, where E(z) is the longitudinal-position-dependent longitudinal magnetic field error induced by magnetism of the drill string and the bottom-hole assembly, and solving the function [Gx, Gy, Gz, Bx, By, BZe] to determine said heading.

The present invention further provides apparatus for carrying out the immediately foregoing method of surveying the heading of a borehole, said apparatus comprising an instrumentation package containing at least two longitudinal magnetic field measuring devices having a known fixed mutual separation(s), two further magnetic field measuring devices for contemporaneously measuring magnetic fields in two mutually orthogonal axes each also orthogonal to the longitudinal axis, three gravity vector component measuring devices for contemporaneously measuring gravity vector components in each of the said three axes, and a recording means to which each of said magnetic field measuring devices and each of said gravity vector component measuring devices is connected for recording the respective measurements of the respective magnetic fields and the respective measurements of the respective gravity vector components when said instrumentation package is within the substantially non-magnetic drill collar.

The present invention still further provides apparatus for carrying out the method of surveying magnetic azimuth and for carrying out at least the magnetic azimuth survey step of the method of surveying the heading of a borehole, said apparatus comprising an instrumentation package containing longitudinal magnetic measuring means for measuring the longitudinal magnetic field at a plurality of positions along the longitudinal axis, said instrumentation package further containing determining means for directly or indirectly determining the respective absolute or relative distances along the longitudinal axis of the positions at which the plurality of longitudinal magnetic field measurements are made.

BRIEF DESCRIPTION OF THE DRAWINGS

Embodiments of the invention will now be described by way of example with reference to the accompanying drawings wherein.

DESCRIPTION OF THE PREFERRED EMBODIMENTS

Figure 3:
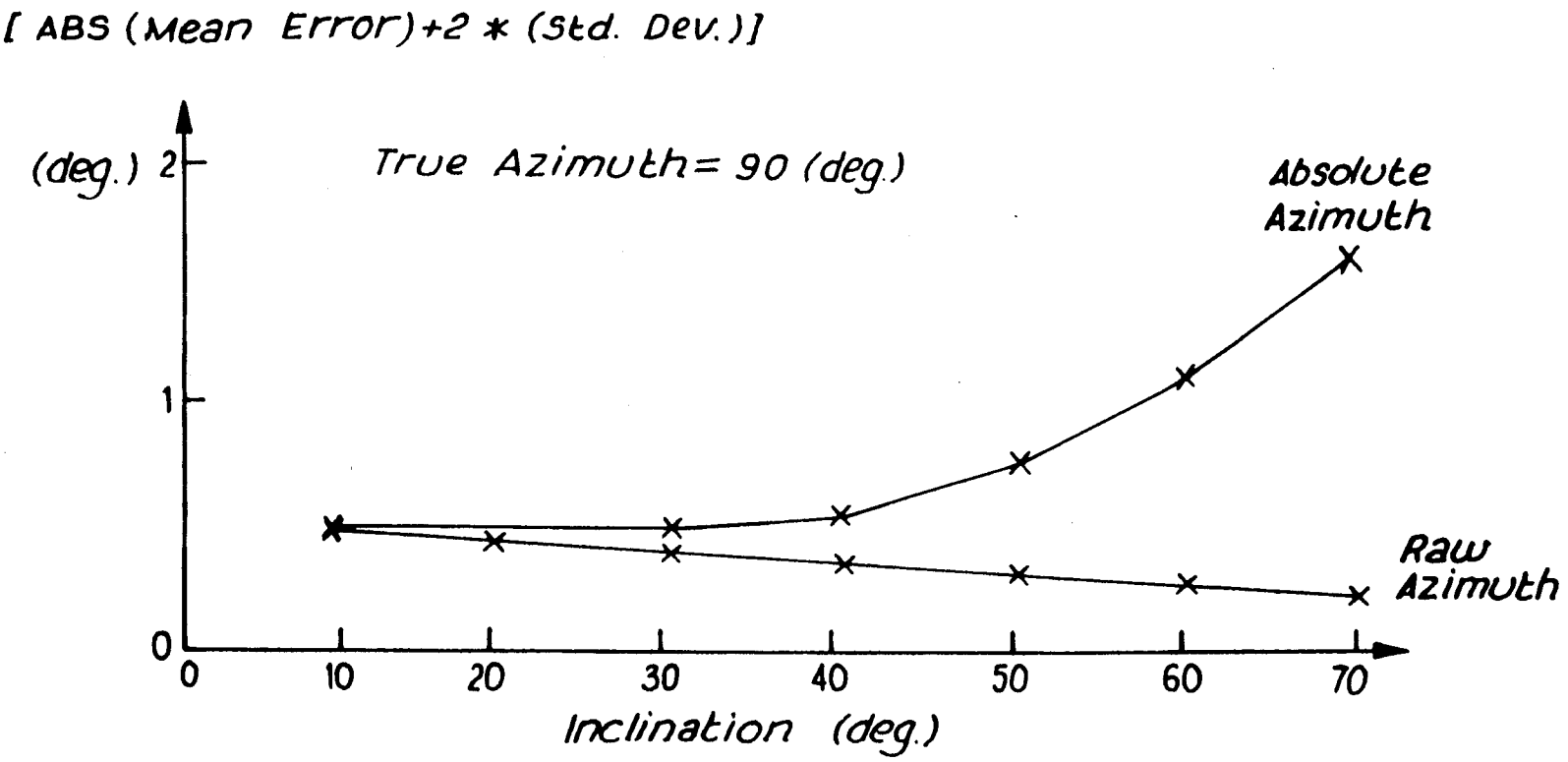
FIG. 3 is a graphical representation of the variation of azimuth reading errors with inclination, for a typical present day instrumentation package.

FIG. 3 indicates the relative accuracies of determining the raw and absolute azimuths for the worst-case situation when the local axial magnetic field vector measuring instrument is lying with its longitudinal axis east/west; the values are calculated using a set of errors representative of the limit of what is achievable for present-day instruments.

For the sake of convenience in referring to magnetic perturbations of local magnetic fields, the bottom hole assembly comprising the drilling bit 10 (and any associated magnetic components) will subsequently be referred to as the "BHA", the drill collars 14 and drill string 16 (plus any associated magnetic components) will subsequently be referred to as the "DS", and the non-magnetic drill collar 12 will subsequently be referred to as the "NMDC".

This invention concerns a method of determining absolute azimuth without the need to use accurate Earth's field data and without the problems associated with degradation of the calculation due to attitude changes. The method itself is dependent on two key factors:

(a) A knowledge of the axial magnetic component (BZ) at distributed points along the axis of the NMDC.

(b) The selection of a theoretical magnetic model to represent the cause of the corrupting field due to effects of the DS and BHA.

The accuracy of the method is entirely dependent on the extent to which data of (a) is known since this determines the degree of sophistication which can be used to select the model (b). (While the method will first be described in terms of a magnetic pole model, variations of the method employing non-polar models will be described subsequently).

Figure 1:
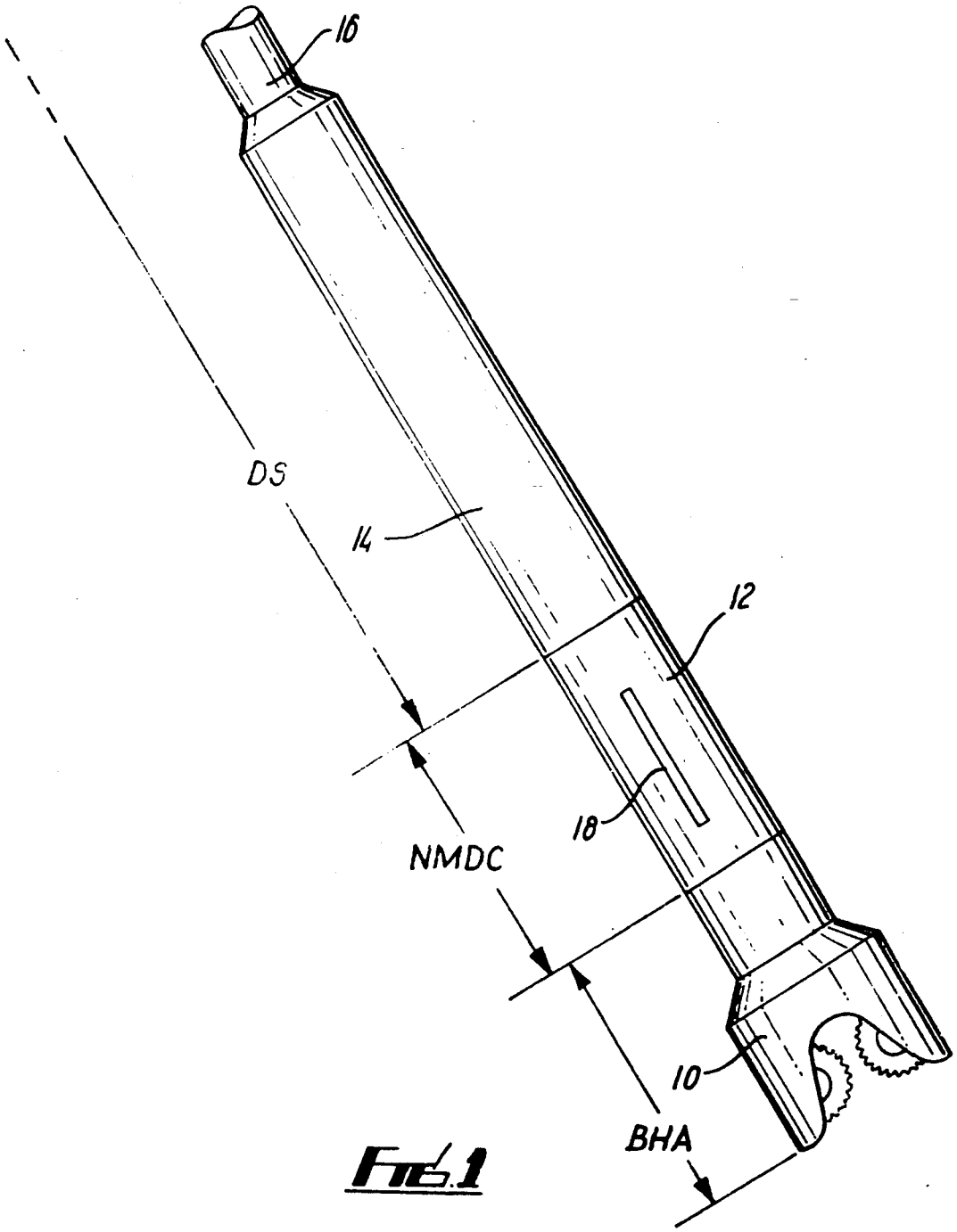
FIGS. 1 and 2 are as previously detailed.
Figure 2:
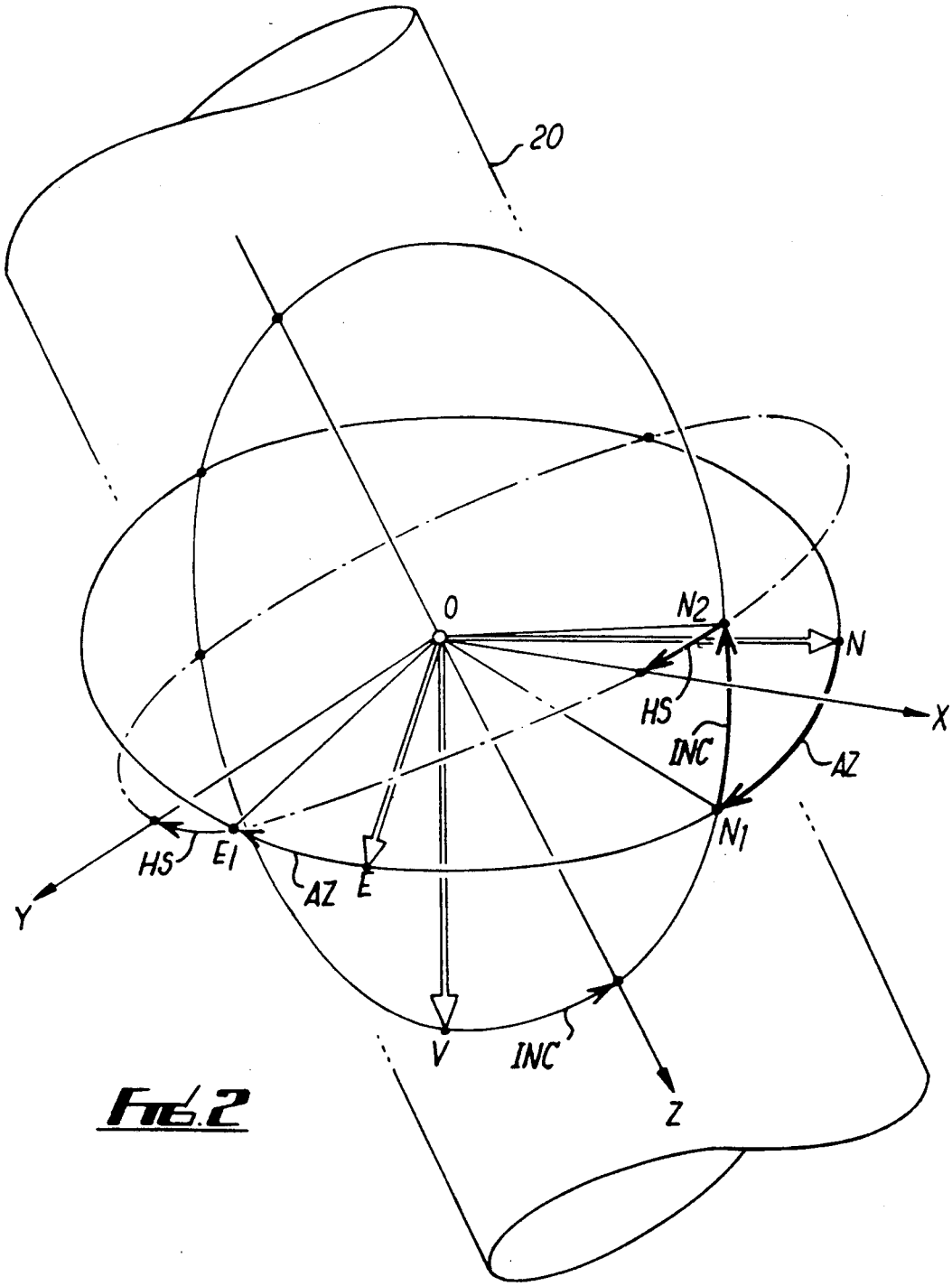

Unless the length of the NMDC is very small, say less than 10 feet, experience shows (as might be expected from FIG. 1) that the effect of the magnetic DS and BHA material is to produce a magnetic error field {E} at a point on the axis of the NMDC and remote from its end with the direction of {E} substantially along the longitudinal axis OZ of the NMDC.

Magnetic models representing this magnetic configuration can be reasonably postulated in terms of notional magnetic poles of various strengths distributed along the NMDC axis (OZ) direction. The degree of sophistication for such models will be dependent upon both the number of such magnetic poles employed and the degrees of freedom in their positioning.

The principles of the magnetic polar models will now be described.

If the value of BZ is measured at various points z as measured along the NMDC length (z being zero at one end of the NMDC), then at any such point z, the longitudinal-position-dependent value of BZ is BZ(z) such that:

$$BZ(z) = BZe + E(z)$$

where BZe is the value of the Earth's magnetic field component along OZ, and E(z) is the longitudinal-position-dependent value of the error field {E} at that point.

In terms of any postulated polar magnetic model, E(z) will be a function both of the notional pole strengths and of distances (functions of z) from the points of the notional poles employed in the model, but BZe is invariant with respect to z. If measurement of BZ(z) are made at points along the OZ axis inside the NMDC, then sets of equations can be formed and solved for the unknowns of the model as well as for BZe. Clearly the number of unknowns for the model which can be determined in this manner will be dependent on the number of equations so formed; i.e. on the number of points at which BZ(z) is measured along the NMDC length.

Some magnetic polar models will now be described in detail.

Examples of two magnetic polar models are considered here; the first example is the simplest possible configuration of magnetic poles which might be employed and the second example is probably beyond the limit to which the sophistication for such models needs to be taken to produce more accurate results.

Figure 4:
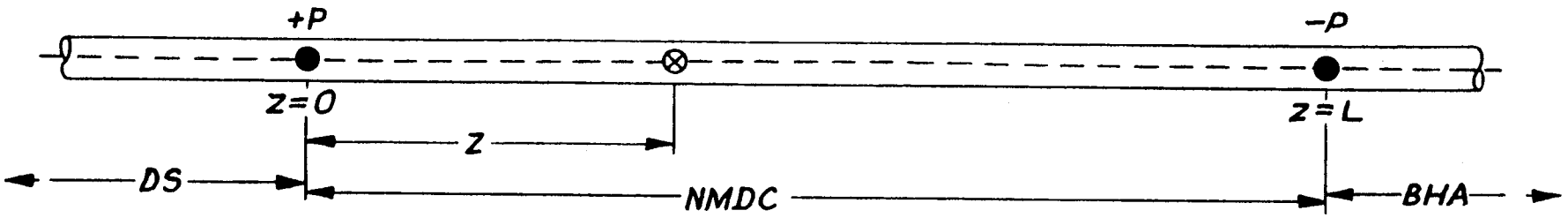
FIG. 4 is a schematic representation of a simple model of an error-inducing notional magnetic pole system.

(i) The simple model is schematically depicted in FIG. 4.

This model considers that the effect of the DS ad BHA may be represented by two poles of equal pole strengths located at each end of the NMDC, each pole having a longitudinal field strength P.

The value of the axial field at distance z from the upper end of the NMDC can be written in terms of this model as:

$$BZ(z) = BZe + E(z) = BZe + P/(L-z)^2$$

with unknowns BZe and P.

Clearly, if measurements are made at two points along the NMDC axis, then two such equations are obtained which can be used to solve for BZe and P (in instrument-magnetic-units). It should be noted that the selection of the locations of the two points at which the measurements are made will be important in practice.

Figure 5:
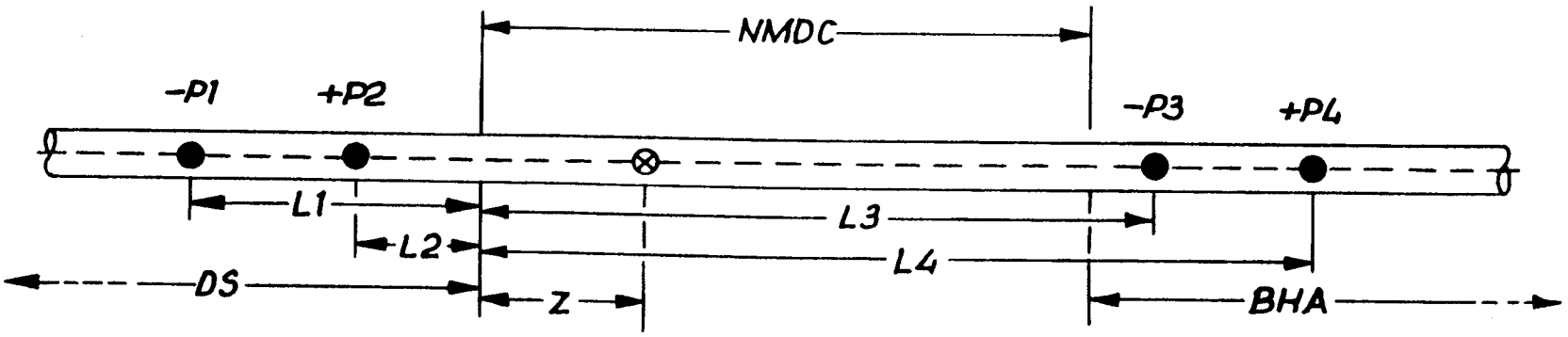
FIG. 5 is a schematic representation of a complex model of an error-inducing notional magnetic pole system.

(ii) The complex model is schematically depicted in FIG. 5.

This model considers the effect of the DS and BHA in terms of four poles with pole strengths P1,P2,P3 and P4 located at distances L1,L2,L3 and L4 respectively from the upper end of the NMDC.

The value of the axial field at distance z from the upper end of the NMDC can be written in terms of this model as:

$$BZ(z)\ BZe + E(z)$$

where $$E(z) = -P1/(L1+z)^2 + P2/(L2+z)^2 + P3/(L3-z)^2 - P4/(L4-z)^2$$

The unknowns in this case are P1,P2,P3,P4,L1,L2, L3,L4 and Bze. Clearly, at least 9 measurements of BZ(z) must be made in order to fully characterise this model.

Acquisition of Data

In order to determine the characteristics of the Error Function E(z) generation model used to predict the effects of the DS and BHA on the magnetic field at points within the NMDC, it is necessary to measure the total axial magnetic field component BZ(z) at points along the axis of the NMDC. Clearly, the instrument package could consist of a series of axial fluxgates at appropriate spacings in addition to the normal configuration of three gravity sensors plus three magnetic fluxgates. However, there are ways to obtain the BZ(z) profile points without the necessity to change to any great extent the present surveying operational procedures:

(i) Single-Shot Survey:

A survey instrument assembly (SIA) is passed down through the DS to a known location within the NMDC. [The SIA may reach its location after free-falling and be retrieved when the complete string is pulled from the hole, or, alternatively, a wireline may be used both to lower and to retrieve the SIA].

With present-day survey instruments, measurements of BZ(z) could be made at short time intervals and stored in memory. The data recorded as the SIA leaves the DS and transverses the NMDC can be correlated with distance along the NMDC axis for a known or presumed velocity profile or constant velocity and, thus, the BZ(z) profile for this transverse can be stored for future processing to determine the magnetic pole model characteristics necessary to allow the determination of BZe at the SIA location.

(ii) Multishot survey:

The SIA, which normally contains at least two magnetic survey instruments, is free-dropped to a known location in the NMDC. Again, BZ(z) can be measured and stored as the SIA transverses the NMDC to its location; with the multiplicity of survey instrument data, it is possible to characterise accurately an Error Function E(z) generation model representative of the DS and BHA at the bottom-hole location.

Survey instrument(s) data is then recorded as the complete string assembly is pulled from the hole; it is possible that, due to induced magnetisation effects, the parameters of the model will need revision as the attitude of the NMDC and SIA changers. For example, at any survey point, the pole strengths in a magnetic pole model can be scaled according to the difference in BZ from two survey instruments spaced at appropriate points along the NMDC axis. Thus, using these models, BZe values can be determined for each survey point.

(A procedure for determining BZe by utilising two axial fluxgates or equivalent devices in a free-fall SIA, and which is applicable to polar and non-polar models, is detailed subsequently).

Relative Accuracies

In the discussion that follows 1 instrument-magnetic-unit is approximately equal to 1 microtesla. The determination of the Earth's magnetic field component BZe in instrument-magnetic-units from the Error Function E(z) generation model is dependent on the degree to which the model chosen is representative of the DS and BHA effects and the accuracy to which differences in BZ(z) at points along the axis (OZ) of the NMDC can be measured; with a multiplicity of data points along the NMDC axis, it should be possible to define a model with sufficient sophistication to represent very closely DS and BHA magnetic effects, and differences in BZ(z) values along the NMDC axis will be independent of the OZ-fluxgate datum errors. Therefore, since it should be possible in practice to match fluxgate scale factors for the OX,OY,OZ fluxgates within an error band of width +/− 0.1%, it is reasonable to suppose that the error band for BZe derived from model approach could be better than +/−0.2 instrument-magnetic-units.

Methods which derive absolute azimuth as a function of (GX,GY,GZ,BX,BY,Be,), where Be' is an assumed known value of one or more components of the Earth's magnetic field Be at the drilling location, effectively require measurements of the magnetic field components (BX,BY,Be) in absolute units. Given this necessity to match the scale factors of the survey instrument fluxgates to an absolute reference, it is optimistic to assume that any component value of the Earth's magnetic field used in the calculation can be known in practice to an accuracy of better than +/−0.2 instrument-magnetic-units.

Figure 6:
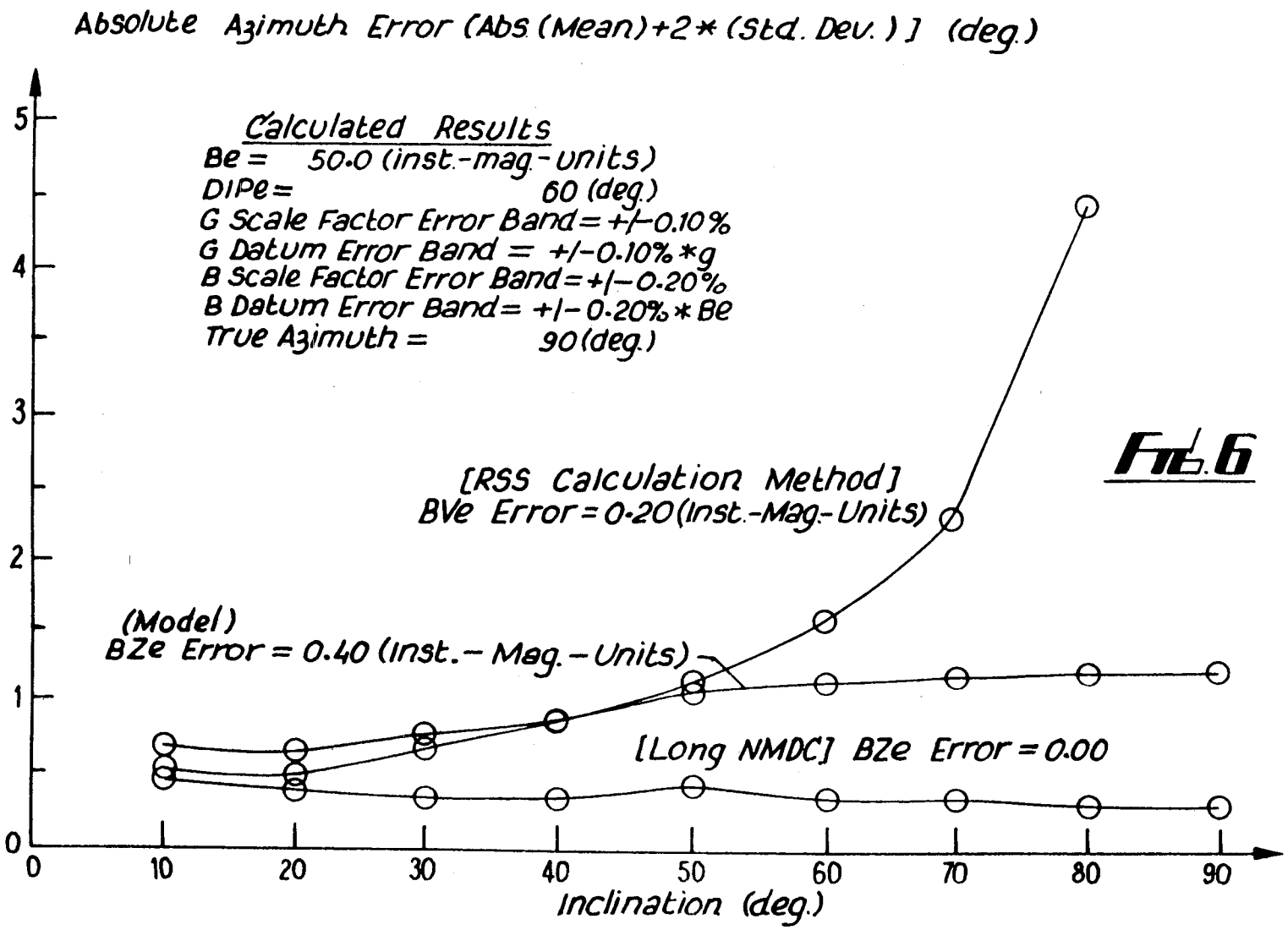
FIG. 6 is a graphical representation of calculated results employing one model of field system.

FIG. 6 shows a comparison for the Error Function E(z) generation model method of this invention and a calculation which determines absolute azimuth as a function of (GX,GY,GZ,BY,BVe), where BVe is the value of the vertical component of the Earth's magnetic field Be at the drilling location (assumed known from independent sources). The error in BVe is taken as +/− 0.2 instrument-magnetic-units (optimistic) and the error in BZe from the model method is taken as 0.4 instrument-magnetic-units (pessimistic). The value of the absolute (or raw) azimuth which would be obtained in a long NMDC configuration with the same instrument error set is also plotted.

The results are based on instrument error bands as follows:

| | | |
|---|---|---|
| Gravity sensors: | Scale factors | +/−0.1% |
| | Datums | +/−0.1% * g |
| Magnetic sensors: | Scale factors | +/−0.2% |
| | Datums | +/−0.2% * Be |

100 sample calculations are performed for each inclination value with the true azimuth taken as 90 degrees (east); the instrument error set and the instrument rotation angle (about OZ) are randomly chosen for each calculation. For comparison purposes, the absolute value of the mean error plus twice the standard deviation is the parameter plotted.

Figure 7:
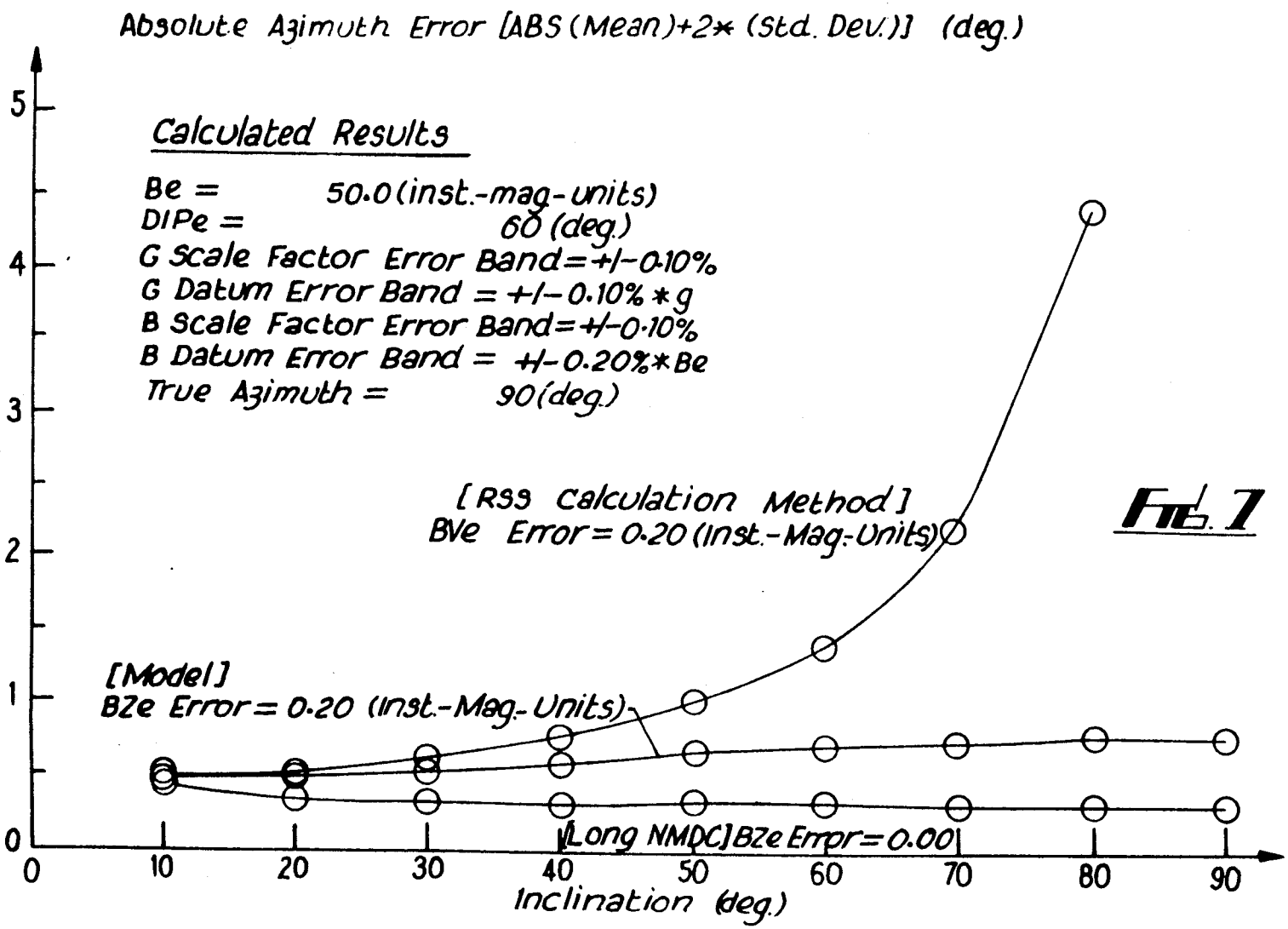
FIG. 7 is a graphical representation of calculated results employing another model of field system.

FIG. 7 shows the same plots for calculations with the magnetic sensor's scale factor error reduced to +/−0.10% and the error in BZe from the model method taken as 0.2 instrument-magnetic-units.

Concluding Comments On Polar Models:

With present-day survey instruments capable of measuring and recording the BZ(z) component of the local magnetic field within the NMDC at a frequency of several times per second, it is possible to obtain a highly detailed profile of the axial magnetic field within the NMDC. The profile can be used to characterise an axial magnetic pole distribution model which will represent the magnetic effect of DS and BHA at points along the axis of the NMDC to a high degree of accuracy. Using this model, the corrupting field can be estimated at any point along the axis of the NMDC and, thus, the axial component of the Earth's magnetic field (BZe) can also be estimated at any such point.

The results of calculations performed and summarised in the plots of FIGS. 6 and 7 suggest that this method will be much superior to the currently used calculations which require an accurate knowledge of the Earth's magnetic field from an independent source. While there is probably little to choose between the methods at inclinations up to about 40 degrees, at greater inclinations the polar method is likely to yield much better results.

Clearly, the most accurate method of obtaining absolute azimuth is still through the employment of a (sufficiently) long NMDC to minimize the DS and BHA effects, but length and cost considerations do not necessarily make this the most attractive means of measurement and the operational advantages of running with a shorter NMDC are considerable.

Non-polar Derivations of BZe:

It has been described above how measurement of BZ(z) can be made at a sufficient number of points along the NMDC axis to permit the solution of a set of simultaneous equations, each in the form:

$$BZ(z)=BZe+E(z)$$

such as the yield the OZ vector value BZe of the Earth's magnetic field (which is the objective of the procedure). The minimum number of such measurements is determined by the complexity of the magnetic pole model used to generate the magnetic distortion function E(z).

However, it is not essential to calculate the function E(z) in terms of a magnetic pole model; any mathematical method which results in the generation of a function E(z) such that the measured distribution BZ(z) is closely represented by E(z)+K (where K is a constant) is sufficient to determine BZe=K.

Moreover, in order to generate the longitudinal-position-dependent longitudinal magnetic error E(z), it is not necessary to know the absolute positions of the measurement points at which the measurements of longitudinal magnetic field BZ are made to provide the longitudinal-position-dependent series of magnetic field measurements BZ(z). It is sufficient to know the positions of the measurement points relative to each other in order to determine the longitudinal magnetic error E(z).

The relative positions of the measurement points are known for the case where the instrumentation package 18 or other local axial magnetic field vector measuring survey-instrument assembly SIA contains a plurality of OZ fluxgates (or of equivalent magnetic measuring devices) at known mutual spacings along the longitudinal OZ axis and is static within the NMDC 12 at the time of measurement, and also for the case where the instrumentation package 18 or other SIA is suspended from a wireline and passes longitudinally through the NMDC 12 at a velocity controlled by the wireline operator on the surface above the well.

In the case where the instrumentation package 18 or other SIA falls freely through the NMDC 12, measurements are not made at known increments of distance because of the uncontrolled rate of fall, but are made and recorded at known times or at known increments of time. A modified form of instrumentation package 18 and a procedure of converting such time-separated measurements for subsequent calculation of BZe will now be described with reference to FIGS. 8 and 9.

Figure 8:
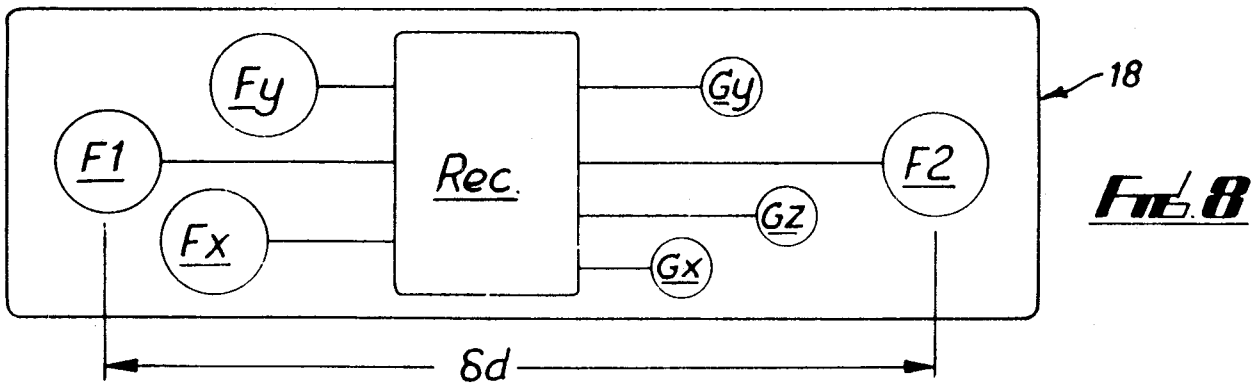
FIG. 8 is a schematic representation of a free-fall instrumentation package for measuring and recording local longitudinal magnetic fields at points having a fixed known mutual separation and at known times or at known increments of time.

Referring first to FIG. 8, the modified instrumentation package 18 comprises a first local axial (OZ) vector measuring fluxgate Fl mounted at the upper (trailing) end of the package 18, and a second local axial (OZ) vector measuring fluxgate F2 mounted at the lower (leading) end of the package 18. The fluxgates F1 and F2 have a fixed mutual axial separation δd ('delta-d') within the package 18. Both fluxgates Fl and F2 are connected to an internal recording device Rec. which records frequent B(z) measurements at known increments of time (or in any other time-dependent reproducible manner) as the package 18 free-falls through the NMDC 12. The instrumentation package 18 also includes fluxgates Fx and Fy respectively measuring the local magnetic field vectors in the OX and OY directions, as well as local gravity vector measuring accelerometers Gx,Gy and Gz, respectively for measuring the local gravitational vector Gx along the OX axis, for measuring the local gravitational vector Gy along the OY axis, and for measuring the local gravitational vector Gz along the OX axis. The fluxgates Fx and Fy, and the accelerometers Gx,Gy and Gz are also connected to the internal recording device Rec. so as to make local gravity vector measurements correlated in time, and hence in position, with the local magnetic vector measurements.

Figure 9:
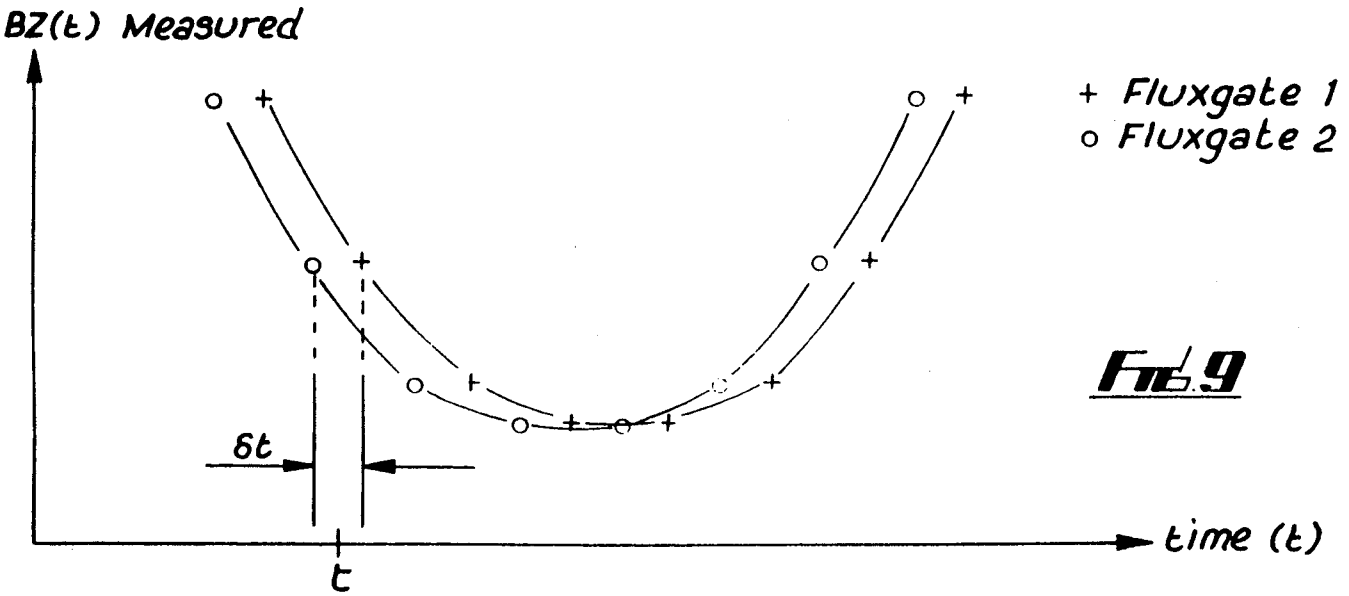
FIG. 9 is a graphical representation of part of a procedure for converting the time-separated measurement obtained by the instrumentation of FIG. 8 to distance-separated measurements.

Referring now to FIG. 9, this shows a twin graph of the two plots of the time-dependent local longitudinal (OZ) magnetic vector BZ(t) with respect to time 't' as measured by each of the fluxgates F1 and F2 (and recorded in the recorder Rec.) while the instrumentation package 18 freely falls down through the NMDC 12. Individual recordings are not denoted on either plot, the discrete markings being subsequently added at selected pairs of points, one on each plot, which are of mutually equal values of BZ(t), though not necessarily at any particular values of BZ(t). The reasons for the addition of such markings are given below.

Taking either of the individual plots of BZ(t) in FIG. 9, the valley-shaped plot is characteristic of the longitudinal magnetic field vector diminishing from an initially high value of BZ as the respective fluxgate leaves the drill string DS and its immediate local magnetic influence, falling to a non-zero minimum approximately mid-way between the drill string DS and the bottom-hole assembly BHA, and rising again as the instantaneous BZ is increasingly influenced by the approach of the fluxgate to the BHA with its local magnetic influence. If the instrumentation package 18 falls at a substantially constant velocity, the two plots will be substantially identical, but mutually slightly displaced along the horizontal time axis 't', whereas if the package 18 changes its velocity [due to transient or continuous acceleration(s) and/or deceleration(s)], the two plots will not be identical. However, the procedure described below enables the time-dependent plots BZ(t) to be converted to the requisite position-dependent plots BZ(z) for subsequent calculation of BZe, without any need to assume any particular constant velocity or velocity profile for the instrumentation package 18 in its uncontrolled longitudinal passage through the NMDC 12. (The procedure is also applicable to the case where the instrumentation package 18 is lowered at a known or controlled velocity (e.g. by being lowered on a wireline) but such known or controlled velocity does not have to be taken into account).

The time/position conversion procedure depends on the fact that, regardless of velocity or of velocity changes, each of the fluxgates Fl and F2 will pass through the same longitudinal position along the OZ axis (albeit at different times), and hence through the same local longitudinal magnetic field. Thus any two adjacent points, one on each adjacent fluxgate plot, which are at mutually equal values of the local longitudinal magnetic field BZ(t) represent the successive passages of the two fluxgates through the same longitudinal position. The horizontal separations of any such adjacent pair of equi-valued points of BZ(t) is the time interval δt('delta-t') from the passage of the leading fluxgate F2 until the trailing fluxgate F1 passes the same point. Since the fluxgates F1 and F2 have a known separation δd which is constant (invariant with respect to time), this separation δd divided by the relevant time interval δt at any point of the traversal of the NMDC 12 is the velocity of the package 18 at that point. This yields a velocity/time profile which can be integrated to derive distance values giving relative positions at which the initially selected values of BZ apply.

Reverting to FIG. 9, adjacent pairs of points on the two plots of BZ(t) are selected, at mutually identical values of BZ(t). The points on the plot of measurements form the trailing fluxgate Fl are denoted by a "+", while the points on the plot of measurements from the leading fluxgate F2 are denoted by an "o". For any arbitrarily selected point on one plot, there is a unique adjacent point on the adjacent plot at the identical value of BZ(t). The actually selected points need not have any specific value, nor any mutually related values, save that their number and distribution are at least sufficient to provide the requisite accuracy in producing the resultant velocity/time profile; by way of example only, FIG. 9 depicts eight such pairs of points at approximately equal intervals along the horizontal time axis 't'.

The time 't' attributed to any given pair of points on the pair of BZ(t) curves can be referenced to the trailing fluxgate Fl (points denoted "+"), or referenced to the leading fluxgate F2 (points denoted "o"), or referenced to a point mid-way between these points, as illustrated by way of example in FIG. 9 for the second pair of points only.

Having obtained the speed/time function and then (by integration) obtained the distance/time function therefrom, as the basis of derivable relative positions, all as described above, the resultant derived values of BZ(z) can be utilised in any suitable polar or non-polar magnetic error function model as previously described to derive the value of BZe as the value of the longitudinal (OZ axis) vector component of the terrestial magnetic field within the borehole 20 at the time and place of the original measurements of local magnetic and gravity vectors. This value of BZe, in conjunction with the contemporaneous measured values Bx,By,Gx,Gy and Gz of the local gravity vectors (produced respectively by the fluxgates Fx and Fy, and the accelerometers Gx,Gy and Gz within the modified instrumentation package 18 of FIG. 8), yield a function (Gx,Gy,Gz,Bx,By,Bz) which can be resolved as previously described to yield the heading of the borehole 20 at the location of the NMDC 12.

Alternative procedures for resolving the borehole heading from fewer than all six orthogonal gravity and magnetic vectors may be employed without departing from the scope of the invention, which essentially lies in the novel method of determining BZe. It is equally within the scope of the present invention that if the value of BZe were the only unknown to be determined, this single unknown could be determined by the method of the present invention. (In either of these cases, one or more of the fluxgates Fx and Fy and/or the accelerometers Gx,Gy and Gz within the instrumentation package 18 of FIG. 8 might then be redundant, but this would not affect the essential scope of the method of the present invention).

While certain modifications and variations have been described above, the invention is not restricted thereto, and other modifications or variations can be adopted without departing from the scope of the invention as defined in the appended claims.

We claim:

1. A method of surveying the magnetic azimuth of a borehole penetrated by a magnetic drill string coupled through a substantially non-magnetic drill collar to a magnetic bottom-hole assembly, by deriving the true magnitude of the terrestial magnetic field BZe in the direction of the longitudinal axis of the borehole in the region of the substantially non-magnetic drill collar, said method comprising the steps of, providing apparatus for measuring the longitudinal magnetic field BZ at a plurality of points along the length of the substantially non-magnetic drill collar to provide a longitudinal-position-dependent series of magnetic field measurements BZ(z), operating said apparatus to measure the longitudinal magnetic field BZ at a plurality of points along the length of the substantially non-magnetic drill collar to provide a longitudinal-position-dependent series of magnetic field measurements BZ(z), and calculating BZe on the basis that $BZ(z)=BZe+E(z)$, where E(z) is the longitudinal-position-dependent longitudinal magnetic field error induced by magnetism of the drill string and the bottom-hole assembly.

2. A method as claimed in claim 1 wherein the calculation of BZe is based on the assumption that the longitudinal magnetic field error E(z) is induced by a plurality of notional magnetic poles longitudinally distributed along the longitudinal axis adjacent the substantially non-magnetic drill collar.

3. A method as claimed in claim 2 wherein the plurality of notional magnetic poles assumed to be inducing the longitudinal magnetic field error E(z) comprises one pole pair.

4. A method as claimed in claim 2 wherein the plurality of notional magnetic poles assumed to be inducing the longitudinal magnetic field error E(z) comprises a plurality of pole pairs.

5. A method as claimed in claim 1 comprising the step of generating the function E(z) such that the measured distribution BZ(z) is closely represented by E(z)+K (where K is a constant) such that BZe=K.

6. A method as claimed in claim 1 wherein the measurements of longitudinal magnetic field BZ are performed by at least two longitudinal magnetic field measuring devices having a known fixed mutual separation(s) and which are passing longitudinally through the substantially non-magnetic drill collar during said measurements, a plurality of such measurements being performed by each said device at known times or at known increments of time to produce respective time-dependent local longitudinal magnetic field vectors BZ(t), deriving increments of time therefrom at selected values of BZ on the basis that said devices successively pass through any given longitudinal position and measure equal values of BZ thereat such that said increments of time represent the time differences of such successive passes, dividing said increments of time by the mutual separation(s) of said devices to derive a velocity/time function of the passage of said devices through said substantially non-magnetic drill collar, and integrating said velocity/time function to derive distance values giving relative positions at which the selected values of BZ apply whereby to derive said longitudinal-position-dependent series of magnetic field measurements BZ(z).

7. A method of surveying the heading of a borehole penetrated by a magnetic drill string coupled through a substantially non-magnetic drill collar to a magnetic bottom-hole assembly, by deriving the true magnitude of the terrestial magnetic field BZe in the direction of the longitudinal axis of the borehole in the region of the substantially non-magnetic drill collar, said method comprising the steps of providing apparatus for measuring the longitudinal magnetic field BZ at a plurality of points along the length of the substantially non-magnetic drill collar to provide a longitudinal-position-dependent series of magnetic field measurements BZ(z), apparatus for measuring the magnetic fields Bx and By in two mutually orthogonal axes each also orthogonal to the longitudinal axis, and apparatus for measuring gravity vector components in each of said three axes to produce respective gravity vector measurements, Gx, Gy, and Gz, operating said apparatus to measure the longitudinal magnetic field BZ at a plurality of points along the length of the substantially non-magnetic drill collar to provide a longitudinal-position-dependent series of magnetic field measurements BZ(z), contemporaneously measuring the magnetic fields Bx and By in two mutually orthogonal axes each also orthogonal to the longitudinal axis, contemporaneously measuring gravity vector components in each of the said three axes to produce respective gravity vector measurements Gx, Gy and Gz, calculating BZe on the basis that BZ(z)=BZe+E(z), where E(z) is the longitudinal-position-dependent longitudinal magnetic field error induced by magnetism of the drill string and the bottom-hole assembly, and solving the function [Gx, Gy, Gz, Bx, By, BZe] to determine said heading.

8. Apparatus for surveying the magnetic azimuth of a borehole penetrated by a magnetic drill string coupled through a substantially non-magnetic drill collar to a magnetic bottom-hole assembly, by deriving the true magnitude of the terrestial magnetic field BZe in the direction of the longitudinal axis of the borehole in the region of the substantially non-magnetic drill collar, said apparatus comprising an instrumentation package containing at least two longitudinal magnetic field measuring devices having a known fixed mutual separation(s), and a recording means to which said magnetic field measuring devices are connected for recording a plurality of longitudinal magnetic field measurements performed by each said device at known times or at known increments of time as said instrumentation package moves through said substantially non-magnetic drill collar.

9. Apparatus for surveying the heading of a borehole penetrated by a magnetic drill string coupled through a substantially non-magnetic drill collar to a magnetic bottom-hole assembly, by deriving the true magnitude of the terrestrial magnetic field BZe in the direction of the longitudinal axis of the borehole in the region of the substantially non-magnetic drill collar, said apparatus comprising an instrumentation package containing at least two longitudinal magnetic field measuring devices having a known fixed mutual separation(s), two further magnetic field measuring devices for contemporaneously measuring magnetic fields in two mutually orthogonal axes each also orthogonal to the longitudinal axis, three gravity vector component measuring devices for contemporaneously measuring gravity vector components in each of said three axes, and a recording means to which each of said magnetic field measuring devices and each of said gravity vector component measuring devices is connected for recording the respective measurements of the respective gravity vector components when said instrumentation package is within the substantially non-magnetic drill collar.

10. Apparatus for surveying the magnetic azimuth of a borehole penetrated by a magnetic drill string coupled through a substantially non-magnetic drill collar to a magnetic bottom-hole assembly, by driving the true magnitude of the terrestrial magnetic field BZe in the direction of the longitudinal axis of the borehole in the region of the substantially non-magnetic drill collar, said apparatus comprising an instrumentation package containing longitudinal magnetic field measuring means for measuring the longitudinal magnetic field at a plurality of positions along the longitudinal axis of the borehole, said instrumentation package further containing determining means for determining the respective distances along the longitudinal axis of the positions at which the plurality of longitudinal magnetic field measurements are made.

* * * * *